United States Patent [19]

Bergström

[11] Patent Number: 4,617,776

[45] Date of Patent: Oct. 21, 1986

[54] BUILDING ELEMENT HAVING SPACED LONGITUDINAL MEMBERS WITH EACH MEMBER HAVING A DIFFERENT MOISTURE CONTENT

[75] Inventor: Ulf Bergström, Bromölla, Sweden

[73] Assignee: Armerad Betong Vagforbattringar AB, Stockholm, Sweden

[21] Appl. No.: 456,080

[22] PCT Filed: Apr. 22, 1982

[86] PCT No.: PCT/SE82/00126

§ 371 Date: Dec. 17, 1982

§ 102(e) Date: Dec. 17, 1982

[87] PCT Pub. No.: WO82/03646

PCT Pub. Date: Oct. 28, 1982

[30] Foreign Application Priority Data

Apr. 23, 1981 [SE] Sweden ..... 8102568

[51] Int. Cl.[4] ..... E04C 3/30; E04C 3/36

[52] U.S. Cl. ..... 52/690; 52/1; 52/404

[58] Field of Search ..... 52/690, 691, 404, 1

[56] References Cited

U.S. PATENT DOCUMENTS 1,923,195 8/1933 Finck ..... 52/404

FOREIGN PATENT DOCUMENTS 13563 7/1980 European Pat. Off. .
2267428 4/1974 France .
2286252 4/1976 France .
413923 6/1980 Sweden .
417227 3/1981 Sweden .

*Primary Examiner*—Alfred C. Perham
*Attorney, Agent, or Firm*—Beveridge, DeGrandi & Weilacher

[57] ABSTRACT

The present invention concerns a prefabricated composite and relatively strong, but light-weight building element which in a simple embodiment consists of two substantially parallel elements (1, 2) spaced apart a given distance and interconnected by intermediate spacer and interconnecting means (3). The invention is characterized in that said prefabricated building element, in order to compensate for expected climatic differences at opposite sides of a building structure, or to compensate for expected loads in the position of use of said prefabricated building element, during or immediately after assembly and interconnection of the parts of said building element has at one of the long sides of said building element a camber (curvature) produced by the different moisture ratios of the two longitudinal elements.

The invention also comprises a method of manufacturing said prefabricated building element, and this method is characterized in that the longitudinal elements are preconditioned to the moisture ratio state which they are expected to assume in their position of use, and in this state are connected with said interconnecting and spacer means.

5 Claims, 7 Drawing Figures

BUILDING ELEMENT HAVING SPACED LONGITUDINAL MEMBERS WITH EACH MEMBER HAVING A DIFFERENT MOISTURE CONTENT

The present invention relates to a prefabricated building element.

The present invention has for its object to provide a deformable building element which, in the environment in which it is to be used, obtains a contemplated, usually straight form.

It is well known that timber, fibreboard and other moisture-sensitive materials tend to be deformed when as a result of shrinkage or swelling, one side becomes longer or shorter than an opposite side. This is a common occurrence in, for example, doors of core-board and wooden studs, i.e. such studs as are used as spacer members between wall surfaces, and usually manifests itself in that one side is curved convexedly, while the other side becomes concave.

Also loads in one direction may cause similar deformation in building elements.

The present invention has for its object to provide a building element which, under the climatic and/or loading conditions to which the element is subjected during use, has an expected shape, which means that the building element under other conditions may have a shape different from the expected shape.

In particular, the present invention has for its object to eliminate the problem that heat-insulated structures are deformed by uneven moisture distribution in cross-section because colder parts will attain a higher moisture ratio than less cold parts. For example, it is not unusual that the outer part of a wooden stud, because of its lower temperature, assumes a state having a higher moisture ratio than the inner part of the stud, as a result of which the material swells and is deformed.

These objects have now been realized by imparting to the building element the characteristic features which are stated in claim 1 and, for preferred embodiments, the characteristic features which are stated in claim 2.

As will appear from the claims and the following description, the problem of deformation is eliminated or alleviated simplest by deliberately selecting, for the parallel elements to be interconnected by means of transverse elements, different moisture ratios or materials for "incorporating" a balanced camber into the building element, thereby to impart to said building element a pre-warping in such a direction that it tends to be eliminated or reduced primarily by climatic differences on opposite sides of the building element in the environment in which it is to be used.

Figure 1:
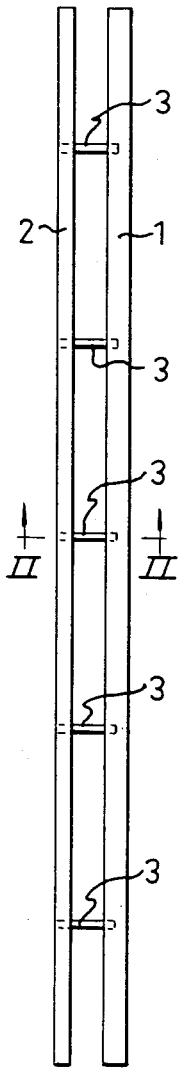
Figure 2:
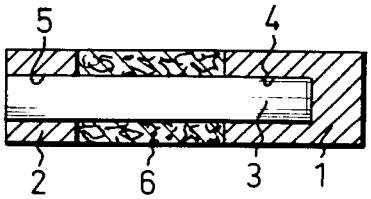
Figure 3:
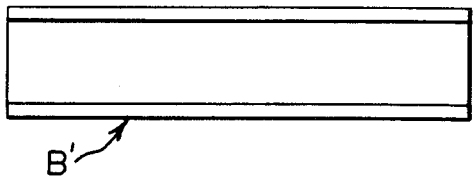
Figure 4:
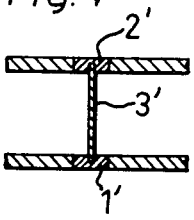
Figure 5:
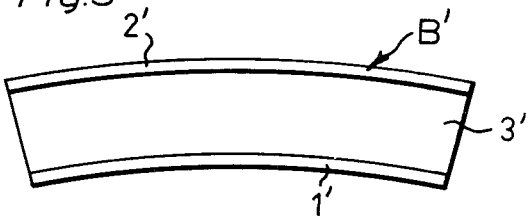
Figure 6:
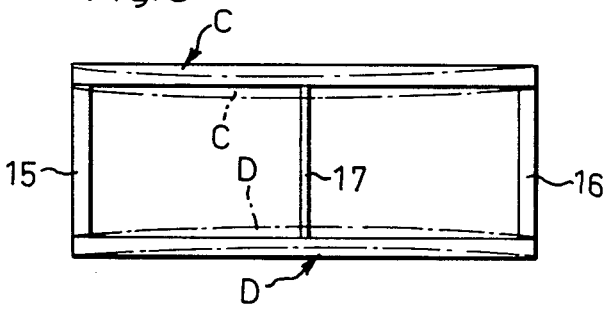
Figure 7:
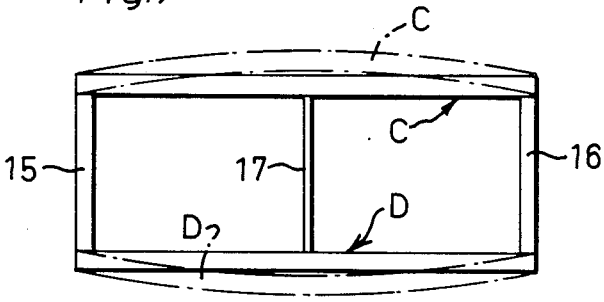

The invention will be described in more detail in the following, reference being had to the accompanying drawing in which FIG. 1 is a side elevational view of a vertical stud according to the invention, FIG. 2 is a cross-sectional view of said stud, taken along the line II—II in FIG. 1, FIGS. 3 and 4 are respectively a diagrammatic side elevational view and a cross-sectional view of a building element of basically the same type as the element shown in FIG. 1, but serving as a beam in an anticipated climatic environment having a higher moisture ratio at the upper side than at the underside, FIG. 5 is a diagrammatic view of the element shown in FIG. 3, in an environment having the same moisture content at the upper side and the underside, for instance in a store-room, FIGS. 6 and 7 are diagrammatic sections of a house with upper and lower floor structures consisting of floor elements which, in principle, correspond to the beam according to FIG. 3 and are shown by full lines in the straight shape which is desired and by dash-dot lines and with exaggerated deformation in the shape they would assume if they were allowed to be deformed freely by variations in the moisture ratio.

FIGS. 1 and 2 illustrate a composite stud A according to the invention, consisting of two rather slender wooden elements 1, 2 interconnected in spaced apart relationship by a number of spacer members 3 in the form of wooden pins, the ends of which are inserted in holes provided in the stud elements 1, 2, for example throughholes 5 in one stud element and blindholes 4 in the other stud element. In the space between the two stud elements 1, 2, a heat-insulating strip 6 of, for example, mineral wool or other suitable insulating material may be provided, the wooden pins extending through holes provided in the insulating material. If the insulating material consists of a self-supporting or rigid insulating strip or rail, the holes provided in said rail or strip for the pins may be formed or drilled before or during the application of said pins. In the embodiment which is best illustrated in FIG. 2, the pins can be inserted into the blindholes 4 in the wooden stud 1 after first having penetrated the stud element 2 and the insulating material 6. The wooden pins may be glued or fitted in the holes 4, 5 of the elements 1, 2 with an interference or sliding fit.

The composite stud may be of any desired length, width and thickness (depth). For the stud width, a suitable width of the stud elements 1, 2 is chosen. The desired thickness (depth) naturally is determined to some extent by the thickness of the stud elements 1, 2, but may also be determined by the length of the wooden pins. The number and dimensions of the wooden pins largely determine the dimensions and strength of the wooden stud according to the invention, which may be compared to a beam of, for example, I cross-section having a web provided with large weight-reducing apertures, i.e. the web consist of the wooden pins and the apertures in said web consist of the vertical spaces between adjacent pins, which spaces may be filled with the insulating material 6.

Regardless of its dimensions, a characteristic feature of a composite stud according to the invention is the fact that it is, in every dimension, substantially lighter than a solid stud of the same dimensions and material and may be dimensioned for withstanding forces occurring in the longitudinal direction of the stud and perpendicular thereto. Thus, the light-weight stud according to this invention may be subjected to loads occurring in the longitudinal direction of the elements 1, 2 and loads perpendicular thereto in the longitudinal direction of the pins 3.

A further characteristic feature of the composite wooden stud A according to FIGS. 1 and 2 is that it is substantially straight along its entire length in the environment in which it is used, for example between two walls (not shown) and at different moisture ratios and temperatures at opposite sides of the stud. It is assumed that on one side of the stud the temperature is higher and the moisture content is lower than on the other side of the stud.

In order to impart to the stud, in the environment described above, the straight shape which is shown in FIGS. 1 and 2, the stud may be made from parts which have the same moisture content (moisture ratio 1) and are so dimensioned and shaped that the stud, when subjected in its position of use to different air humidities on either side, is deformed to the desired straight shape. However, it will be simpler to make the stud from elements 1, 2 which already have a moisture ratio corresponding to the moisture ratio which the stud will attain in its position of use.

To explain in more detail how this is achieved and also to show how the invention may be used in a wider perspective, the following examples are given of the application of the invention to a composite beam which, besides, may be compared in principle to a horizontal stud of the type shown in FIGS. 1 and 2.

The beam B′ shown in FIGS. 3 and 4 is assumed to be of I cross-section. The flanges 1′, 2′ may consist of wooden panels or fibreboard or particle board, and the web 3′ may consist of a series of short panel-shaped elements, or of rods or pins 3′ of a type similar to the elements 3 in FIGS. 1 and 2. The most advantageous construction in these respects will depend int.al. upon the weight of the load to be carried by the beam. In FIG. 4, the beam B is shown with relatively short flanges 1′, 2′ to which walls 10′ and 20′, respectively, are connected. These walls may be affixed to or integrated with the flanges 1′, 2′, and in the latter case the walls actually constitute parts of the prefabricated beam composed of the web and the flanges.

The beam B′ in FIGS. 3 and 4 which for the sake of simplicity is assumed in the following to consist of the elements 1′, 2′ and 3′ in FIG. 4, may be prefabricated to the predeformed shape of which FIG. 5 is an exaggerated view and is so calculated in advance with regard to the environment and the load to which the beam is assumed to be subjected in its position of use that the beam will thereby be redeformed to the straight shape illustrated, but, as will be apparent already from the above, the beam may alternatively be prefabricated of a material having such a moisture distribution that the beam flanges 1′, 2′ at the connection with the "web of the beam", i.e. the elements which are to serve the purpose of the beam web 3′, already have substantially the same moisture ratio as is expected at the contemplated location of use.

In the last-mentioned case, the beam B may be manufactured straight but with flanges having different moisture ratios. Upon equalization of moisture during storage in, for example, a store-room with uniform air humidity, the beam is curved, but if the moisture ratio of the timber during manufacture is correctly adapted to the expected climatic conditions and the load on the beam in the contemplated position of use, the beam will there resume its straight or approximately straight shape. This principle of manufacture may, for example, be utilized also in order to avoid damage to or at interior walls or other elements, as will appear from the following examples.

FIGS. 6 and 7 illustrate a building which comprises two external walls 15, 16 and an upper and a lower floor structure C and D, respectively, as well as an interior wall 17. It is assumed that the upper floor structure C adjoins to an attic, while the lower floor structure D adjoins to, for example, a cellar, the moisture content in the attic and in the cellar usually being high in relation to the air humidity in the rooms 18 between the floor structures.

FIG. 6 is an exaggerated view of the shape which the floor structures C, D shown by dash-dot lines strive to assume when the moisture ratios of the floor structure elements assume the values corresponding to the above-mentioned moisture conditions. Although the interior wall can prevent the floor structure elements from being curved in the manner illustrated, both the interior wall 17 and the floor structure elements, will be subjected to load and, in some cases, the interior wall 17 may be deformed.

This can be avoided by mounting curved floor structure elements which, because of the moisture ratio they assume after mounting in position, will assume straight shape.

FIG. 7 illustrates an example in which initially straight floor structure elements C, D having the same moisture ratio are mounted in position and connected to the interior wall 17. Elements C and D tend to be curved in an outward direction by the moisture ratio which they obtain in the position of use. In this manner, cracks may be formed between the floor structure elements and the interior wall. This can be prevented by manufacturing the floor structure elements according to one of the above-described methods so that the floor structure elements. under the moisture conditions in the position of use, will assume straight shape or some other predetermined shape.

Cylindrical wooden pins or pins which are cylindrical and slightly conical at their ends, may be used as spacer members between the stud elements 1, 2 in FIGS. 1 and 2 or the flanges 1′, 2′ in FIGS. 3–5, the holes for the pins being drilled. However, also timber which is, for example, square in cross-section and has rounded end portions, offers essentially the same advantages as cylindrical pins. These elements which serve as spacer members and "beam webs" may, of course, have any desired shape, provided that they do not prevent a contemplated deformation and bending of the elements 1, 2 or 1′, 2′, and provided that they are not themselves damaged thereby. The stud elements 1, 2 or beam flanges 1′, 2′ may have a width greater than the normal width of wooden studs and beams, respectively, and could be combined with or replaced by sheets or panels of some suitable material and having, for example, glued reinforcements with holes provided in one or more rows. These as well as many other modifications are comprised by the scope of this invention.

I claim:

1. A prefabricated building element comprising two substantially parallel, spaced longitudinal members; and at least one spacer and connecting means disposed between and connected to the longitudinal members;

wherein at least said longitudinal members of said prefabricated element, in order to compensate for expected climatic differences at opposite sides of the building element in the position of use in a building structure, are comprised of hygroscopic material, wherein each of said members has a moisture content that is different from moisture content of the other member in said element at the time of production, and wherein the moisture contents of the members are in a moisture ratio, said moisture ratio being the expected moisture ratio between the members when the building element is exposed to two different climatic conditions in the position of use in the building structure.

2. A building element as claimed in claim 1, in which the two parallel longitudinal members are two relatively slender wooden studs joined by a plurality of spacer and interconnecting means in the form of wooden pins, and wherein heat insulation is disposed between the wooden studs, wherein the pins extend through and support the insulation and extend from one stud to the other stud.

3. A building element as claimed in claim 2, in which the insulation is in the form of a longitudinal, relatively rigid strip having holes for the pins.

4. A building element as claimed in claim 3, in which said insulation is comprised of mineral wool.

5. A method of making a composite building element as claimed in claim 1, wherein the two longitudinal members are made of wood or other moisture-absorbing material and are conditioned such that the two members have the same moisture content which they are expected to assume in the contemplated position of use, and such that said members are thereafter interconnected in spaced apart parallel positions by means of an intermediate spacer and interconnecting means serving as a web.

* * * * *